United States Patent [19]

Boettcher

[11] 4,030,251

[45] June 21, 1977

[54] BRUSH ACCESSORY FOR FLOOR SANDERS

[76] Inventor: William A. Boettcher, 4507 N. Clark St., Chicago, Ill. 60640

[22] Filed: Jan. 30, 1976

[21] Appl. No.: 653,913

[52] U.S. Cl. ..... 51/177

[51] Int. Cl.[2] ..... B24B 23/00

[58] Field of Search ..... 51/177, 170 T; 15/399, 15/400

[56] References Cited

UNITED STATES PATENTS

| | | | |
|---|---|---|---|
| 1,869,157 | 7/1932 | Lang | 15/400 |
| 2,025,734 | 12/1935 | Ell | 15/399 |
| 3,882,644 | 5/1975 | Cusumano | 51/170 T |

*Primary Examiner*—James L. Jones, Jr.
*Attorney, Agent, or Firm*—S. J. Lehrer; William F. Frank

[57] ABSTRACT

A marginal floor brush spacedly surrounding the rim of a chambered sanding machine base. The brush meets the floor and confines wood dust developed by a rotary sanding unit in the base. The dust is drawn from under the brush by a vacuum unit in the machine. This is facilitated by disposing the brush floatingly free of the machine to stir up and separate the dust particles and leave the floor clear of dust as the machine moves on.

7 Claims, 4 Drawing Figures

BRUSH ACCESSORY FOR FLOOR SANDERS

This invention relates to machines for sanding floors, and more particularly to means for picking up the wood dust developed by the sanding operation. Sanding machines have a wide, circular base in which a rotary sanding implement operates; and the base has a marginal brush which confines the dust developed by the sanding operation. A vacuum unit in the upper part of the machine connects with the base to draw the dust from it to a point where a disposal bag connects as in an upright house-hold vacuum cleaner. While the marginal brush serves adequately to enclose the area where the dust is drawn into the machine by vacuum, the weight of the machine base causes the marginal brush — which does not rotate — to bear on dust scattered centrifugally by the rotating sanding implement, so that some dust becomes packed under the brush, and is not drawn as mentioned. The dust drawing operation is thus only partly effective, and packed dust remains under the machine, and is left behind as the machine moves on.

In view of the above situation, one object of the present invention is to provide a marginal brush which does not bear weight or pressure from the sanding machine, and will therefore not exert packing influence on the dust scattered under the brush by the sanding implement.

A further object is to design a marginal brush which is free of the machine base, and so light that it will separate rather than rest on dust particles, so that they will be fully drawn into the machine by the vacuum and leave the floor clean.

Another object is to dispose the marginal brush as a floating accessory to stir-up and thin-out the dust wherever the machine travels, for thorough removal by the suction in the machine.

An additional object is to provide a cover for the marginal brush which checks outside air from being drawn into the base of the machine where it may weaken the vacuum within the marginal brush and retard the drawing of wood dust into the machine.

A better understanding of the invention may be gained by reference to the accompanying drawing, in which FIG. 1 is a perspective view of the main portion of a floor sanding machine, showing the application of the marginal brush;

Figure 1:
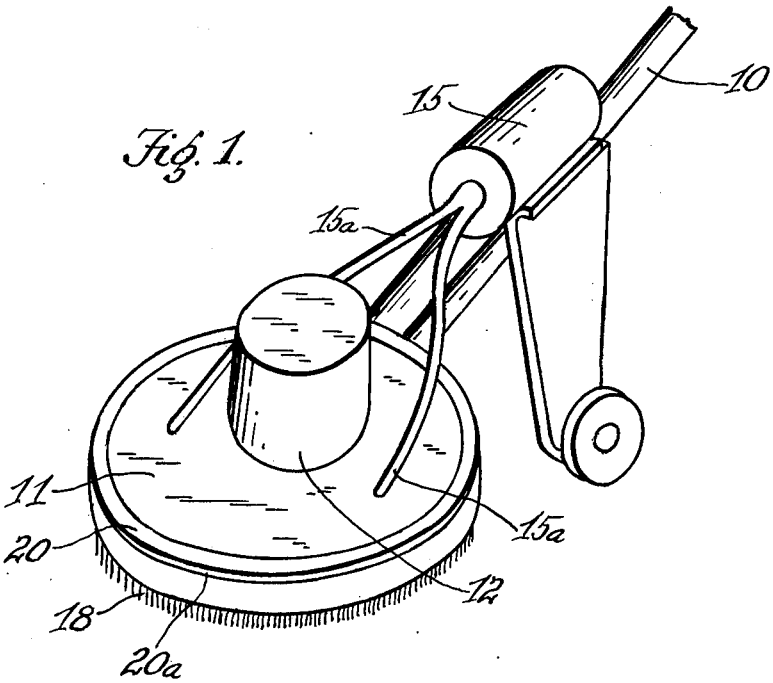
Figure 4:
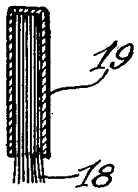
FIG. 4 is a vertical section of the marginal brush on a larger scale.
Figure 2:
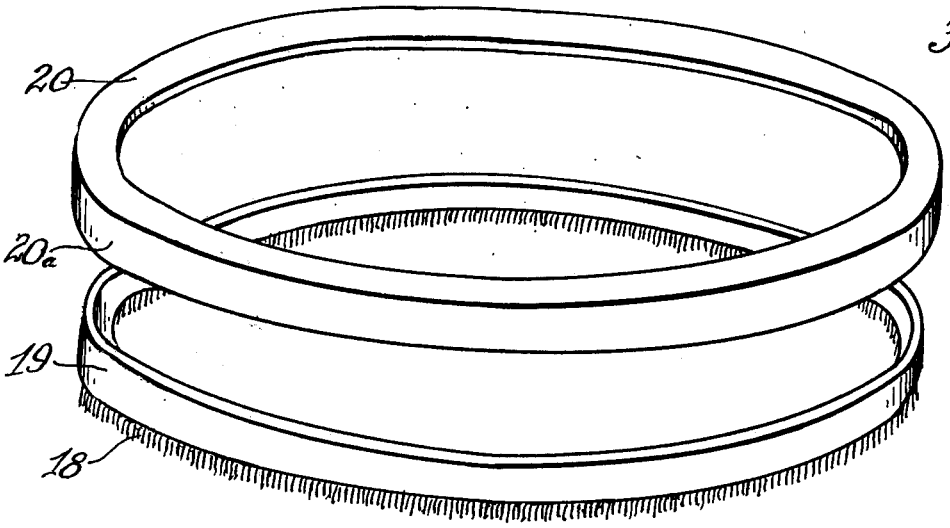
FIG. 2 is a perspective view of the cover and the marginal brush, vertically separated.
Figure 3:
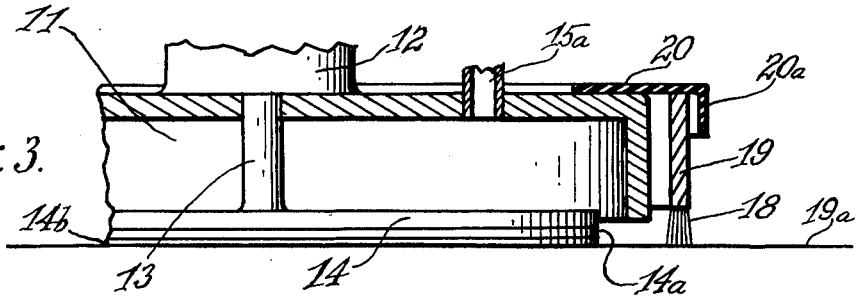
FIG. 3 is an enlarged vertical secton on the line 3—3 of FIG. 1.

Referring specifically to the drawing, 10 denotes the push bar of a typical industrical floor sanding machine. The chambered circular base of the machine is shown at 11; and it has a motor housing 12 for rotating a vertical shaft 13 seen in FIG. 3. The shaft carries a sanding implement in the form of a rotary disc 14, a pad **14*a* and a sanding sheet 14*b*. The wood dust developed by the sanding operation is designed to be drawn into a disposal bag (not shown) by a suitable vacuum unit 15 from which tubes 15*a* lead into the machine base 11 as shown in FIGS. 1 and 3**.

A marginal brush 18 is disposed spacedly around the base rim **10*a*. The brush is carrid by a holder 19, and meets the surface of the floor 19*a* as shown in FIG. 3. The holder 19 is preferably of channel-type sheet aluminum to make the marginal brush light. Thus, it not only confines the wood dust dispersed by the sanding implement within the base 10** as the machine moves across a floor, but stirs up and separates the dust particles to be readily drawn into the machine base by the suction therein, and clear the floor of sand-dust as the machine moves on.

The marginal brush, in order to be floating, is of course well-separated from the rim of the base 10. However, this would leave a passage open at the top for outside air to be drawn into the base, weakening the suction therein. An expedient is provided to prevent this action, which is in the form of a marginal cover 20 of elastic material — such as light rubber — which covers the top corner of the base all around, and drapes with a downbend **20*a* spacedly around the brushholder 19.** The cover is therefore a top closure, yet allows for lateral and vertical play by the brush.

It will now be apparent that the novel marginal brush is an accessory which is free of the machine, yet travels with the same wherever sanding is done. It remains free to be picked up when the machine is raised after a sanding operation; and the cover 20 may be dilated for easy downward removal from the machine base if that is desired. Finally, the accessory is of a nature to be produced at low cost and in sizes to suit machine bases of different diameters.

I claim:

1. In combination with the horizontal base of a floor sanding machine having suction means in the base; a holder freely surrounding the base and a brush directed downwardly from the holder to floor contact, the brush also surrounding the base, the holder and brush being spaced radially from the rim of said base for vertical and radial movement relative to said base; and a cover extending radially along and beyond the top of the base and over the holder with a downbend at its periphery spaced from the holder to restrain and control movement of said holder relative to said base and to direct the entrance of outside air into the base by way of said brush.

2. The structure of claim 1, the holder being a channel-type casing opening downwardly, and the brush being fitted with its upper portion in the casing.

3. The structure of claim 1 where the machine operates with sucton in the base, and a cover over the top of the base and the holder to check the entrance of outside air into the base by way of said top.

4. The structure of claim 1, said cover being of sheet material and elastic with a central opening in its horizontal surface to fit said cover over said base.

5. A brush accessory for a powered sanding machine having a base within which is positioned the sanding means and vacuum means connected to said base for the removal of material removed during the sanding operation comprising, a brushing assembly having a holder which is continuous around its periphery with a brush depending from said holder continuously around said periphery, the interior dimensions of said assembly being greater than the exterior dimensions of said base so as to maintain said assembly in a free movement relative to said base; and a cover for said brush assembly having interior dimensions greater than the exterior dimensions of said assembly and further having a surface depending from the top of surface of said cover, said cover further having a central opening therein for insertion of said cover over said sanding base of said sanding device.

6. In the combination of a floor sander having a horizontally positioned base member containing the motor driven sanding element wherein the interior dimensions of said base are greater than the exterior dimensions of said sanding element so as to provide a chamber within said base to receive materials removed by said sanding element, vacuum means associated with said chamber to collect said removed material, and skirt means associates with said base to restrain said removed material adjacent to said base for removal by said suction means, the improvement comprising: a brush assembly having a holder with a continuous periphery and a brush depending from said continuous periphery, said brush likewise being continuous around the periphery of said holder, said assembly having interior dimensions greater in the horizontal plane than the exterior dimensions of said base and in the vertical plane of a height equal to said base with said sanding element attached thereto, said assembly being unconnected to said base for radial and vertical movement relative to the movement to said base; and a cover assembly comprising a horizontal element having a vertical member depending therefrom, the length of said vertical member being less than the height of said brush assembly, the interior dimensions of said cover assembly being greater than the exterior dimensions of said brush assembly, said cover further having a central opening whose dimensions are such as to permit said holder to be placed over said base and maintaining contact with a circular outer portion of said base.

7. The improvement according to claim 6 wherein the central opening of said cover is of such dimension and at least horizontal element of said cover is of material of sufficient resiliency so that the cover may be dilated and drawn down over said base for removal of said cover.

* * * * *